US006981724B2

(12) United States Patent
Denys

(10) Patent No.: US 6,981,724 B2
(45) Date of Patent: Jan. 3, 2006

(54) MULTI-POINT LOCK ASSEMBLY

(75) Inventor: Andre Denys, Sterling Heights, MI (US)

(73) Assignee: Fasco Die Cast, Inc., Mississauga (CA)

( * ) Notice: Subject to any disclaimer, the term of this patent is extended or adjusted under 35 U.S.C. 154(b) by 63 days.

(21) Appl. No.: 10/436,660

(22) Filed: May 13, 2003

(65) Prior Publication Data

US 2004/0227349 A1 Nov. 18, 2004

(51) Int. Cl.
*E05C 5/00* (2006.01)

(52) U.S. Cl. ..... 292/64; 292/DIG. 53; 52/745.15

(58) Field of Classification Search ..... 292/336, 292/3, 24, 25, 64, DIG. 53; 52/245.15; 70/466
See application file for complete search history.

(56) References Cited

U.S. PATENT DOCUMENTS

| | | | | |
|---|---|---|---|---|
| 1,716,113 | A | 6/1929 | Carlson | |
| 1,794,055 | A * | 2/1931 | Benson | 70/107 |
| 2,092,653 | A * | 9/1937 | Nielsen | 29/407.1 |
| 3,162,472 | A | 12/1964 | Rust | 292/114 |
| 3,413,025 | A | 11/1968 | Sperry | 292/111 |
| 4,643,005 | A | 2/1987 | Logas | 70/95 |
| 4,973,091 | A | 11/1990 | Paulson et al. | 292/51 |
| 5,125,703 | A | 6/1992 | Clancy et al. | 292/337 |
| 5,421,627 | A | 6/1995 | Yane | 292/162 |
| 5,595,409 | A | 1/1997 | Fier et al. | 292/112 |
| 5,603,184 | A | 2/1997 | Campbell et al. | 49/394 |
| 5,738,389 | A | 4/1998 | Marks | 292/63 |
| 5,820,170 | A | 10/1998 | Clancy | 292/26 |
| 5,906,403 | A * | 5/1999 | Bestler et al. | 292/26 |
| 6,009,932 | A | 1/2000 | Smith | 160/371 |
| 6,068,305 | A | 5/2000 | Myers et al. | 292/201 |
| 6,264,252 | B1 | 7/2001 | Clancy | 292/196 |
| 6,491,326 | B1 * | 12/2002 | Massey et al. | 292/162 |
| 2002/0190529 | A1 | 12/2002 | Breslin et al. | 292/56 |

* cited by examiner

*Primary Examiner*—Gary Estremsky
(74) *Attorney, Agent, or Firm*—Young & Basile, P.C.

(57) ABSTRACT

A multi-point latch assembly having a locking unit operably positioned in a closure member such as a door or window. The latch unit has a pair of latches with slots formed therein permitting the latches to simultaneously slide and pivotally engage a stationary pin. A keeper unit is operably positioned in a stationary member such as a door jam in a wall or a window sash. The keeper unit has a pair of pivotally movable hooks for selectively engaging the pair of latches in the latch unit. The latch unit has an actuator unit located internal to the latch unit for causing the hooks and latches to engage one another. The closure member is prevented from moving relative to the stationary member without first disengaging the hooks and latches from one another. The multi-point latch assembly has a stop rod located in the keeper unit. A release button located on the latch unit engages the stop rod when the closure member is closed. The latch unit is incapable of actuating the hooks and latches until the release button contacts the stop rod when the closure member is in a closed position relative to the stationary member.

4 Claims, 10 Drawing Sheets

FIG - 5
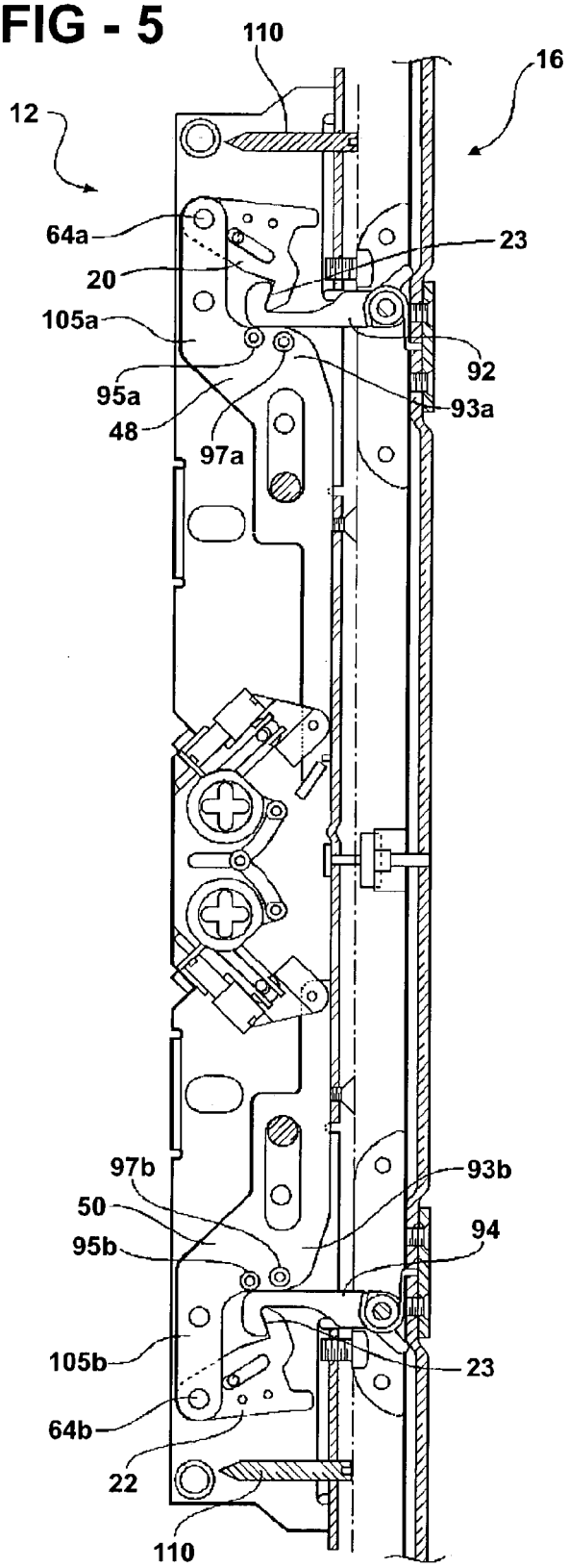
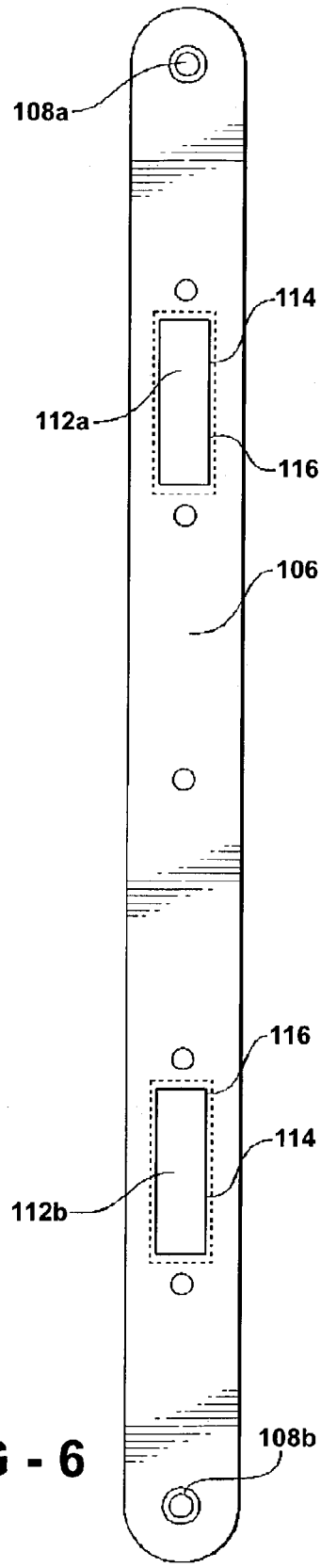
FIG - 6

MULTI-POINT LOCK ASSEMBLY

FIELD OF THE INVENTION

The present invention relates to a multi-point lock assembly having locking hooks positioned in the stationary keeper of a door unit.

BACKGROUND OF THE INVENTION

In a typical sliding door installation, a lock unit having one or more hooked locking members is mounted into a movable door. A keeper unit is mounted into a stationary door opening member or jamb. The door is closed by bringing the lead edge into contact with the jamb and then locked by rotating a thumb turn to cause the locking hooks to extend out from the edge of the door and into the slots in the keeper plate.

A problem associated with this conventional configuration is that because the thumb turn can be operated in any door position, the hooks can be extended prior to the door being closed. If the door is forcibly closed with the hooks extended, damage can be caused to the hooks, to the keeper plate, or to both.

One way to solve this problem is to use hooks which collapse when slammed against the stationary keeper plate. This method of preventing damage to the lock mechanism is more expensive due to the complexity of the design.

SUMMARY OF THE INVENTION

The present invention provides a multi-point lock assembly for sliding closures, such as patio doors, which eliminates the problems associated with the prior art devices as described above.

In general, this is accomplished in an assembly comprising a latch unit which is placed in the sliding closure and a keeper assembly which is placed on the stationary closure frame, typically called a jamb. In accordance with the invention, the keeper is provided with hooks which normally occupy a retracted position but which are rotated to a partially set position by bringing the leading edge of the closure near or into contact with the keeper unit. In the partially set position, the hooks extend into the latch unit, but do not provide a fully activated closure-to-jamb lock until a mechanism on the latch unit, typically a thumb turn or a key, is rotated to activate latches within the latch unit to complete the rotation of the hooks and fully lock the closure to the joint.

The invention can be used with any kind of sliding closure including both patio doors and sliding windows or closure panels.

In an illustrative embodiment of the invention, the multi-point latch assembly has a stop rod located in the keeper unit. A release button located on the latch unit engages the stop rod when the closure member is closed. The hooks and latches are incapable of being actuated until the release button is depressed by the stop rod. The release button is contacted and depressed by the stop rod when the closure member is in a closed position relative to the stationary member.

The hooks include a substantially J-shaped hook portion extending from a pivot center of rotation. The J-shaped hook portion engages a corresponding latch when the latch unit and keeper unit are locked to one another. The hook also includes a tab extending from a center of rotation at an oblique angle relative to the hook portion. An adjustable screw located in the latch unit engages the tab of each hook when the closure member closes. The adjustable screw causes the hook to rotate at a discreet angle out of the keeper unit and into the latch unit.

An actuator for actuating the latch mechanism is located in the latch unit. A pair of upper and lower channel bars, having first and second ends are connected to the actuator at the first ends thereof. The channel bars have an offset extension at the second ends thereof. The offset extension has an aperture for a pivot pin to engage with and extend between each pair of channel bars. The pivot pin pivotally connects with a corresponding latch positioned between the offset extensions. The channel bars include at least one rod extending between an inline portion of each pair of channel bars. The rod engages a corresponding hook that has rotated into the latch unit when the moveable member is closed. The rod then moves the hook into a locked position with the corresponding latches.

In one embodiment of the invention, an adjustable clip is operably associated with each keeper unit for positioning the hooks at a predetermined location relative to the latch unit. Each adjustable clip has two sides and a mounting member extending there between for connecting the clips to a keeper plate.

In an alternate embodiment of the invention, a U-shaped channel keeper is positionably adjustable by attaching a shim to the backside of the U-shaped channel keeper prior to attaching the keeper to the stationary member. A plurality of plastic filler pieces snap in the U-shaped channel keeper adjacent the hooks for providing a flush surface at the edge of the U-shaped channel.

In operation, the multi-point lock requires the closure member to be shut before the hooks can extend outwardly from the keeper during the locking sequence. As the closure member closes, the moveable member engages a tab on each hook causing the hook to rotate outwardly away from the keeper unit. The lock actuator is actuated by turning a key or a thumb turn. The actuator rotates the corresponding latches and the hooks until each are engaged with one another. The tension between the latches and hooks is automatically adjusted via biasing means integral to the actuator system.

An anti-slam feature for the multi-point lock assembly is provided for preventing the hooks and latches from rotating into the locking position when the latch unit, located on the moveable member, is displaced from an engaged position relative to the keeper-unit which is located in the stationary member. A release button, located in the latch unit, is engaged by a stop-rod, located in the keeper-unit, when the moveable member engages the stationary member during closing. Once the release button is depressed, the actuator can be be turned and the lock mechanism is free to complete the locking sequence.

A method for assembling a multi-point lock assembly includes adjusting rollers for aligning the moveable member with the stationary member. Once the moveable member is aligned, at least one pointed head screw is threaded into a trim plate located on the outer edge of the latch unit. The moveable member is then closed a sufficient distance for the pointed head screw to mark the stationary member. The keeper unit is then installed at the marked location so that perfect alignment with the latch unit is achieved. The pointed head screw is then reversed and threaded completely into the trim plate.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein:

FIG. 5 is a side view of the latch unit and keeper-unit locked together;

FIG. 6 is a perspective view of a trim plate;

DESCRIPTION OF THE PREFERRED EMBODIMENT

Figure 1:
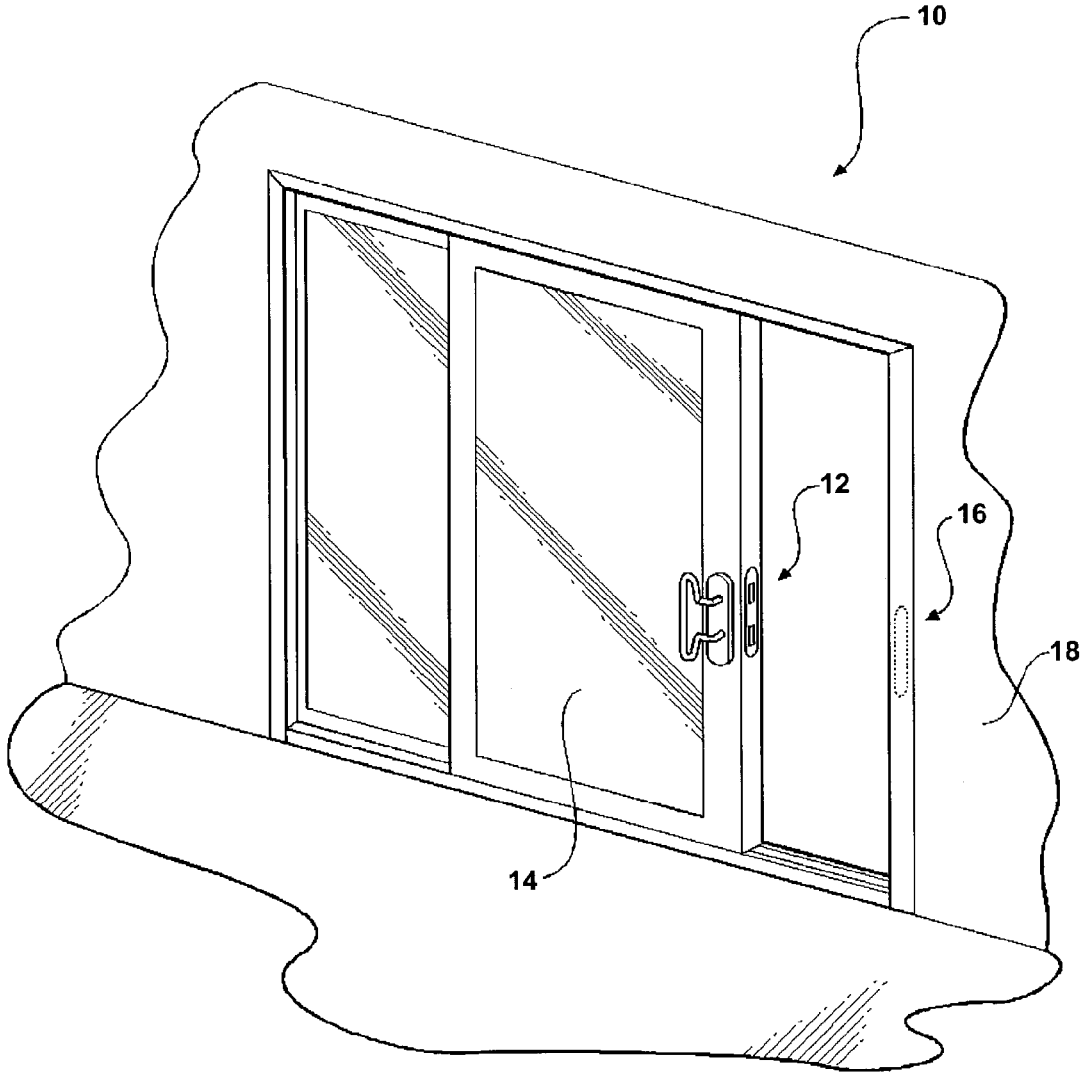
FIG. 1 is a view of a multi-point lock assembly including a latch unit positioned in a sliding door and a keeper unit positioned in a stationary jam.

Referring now to FIG. 1, a multi-point lock assembly 10 located in a typical environment is shown therein. A latch unit 12 is operably positioned in a closure member 14. A keeper unit 16 is operably positioned in a stationary member or jamb 18. The closure member 14 is typically a sliding patio door and the stationary member 18 is typically a frame piece in the wall of building as depicted in FIG. 1. The multi-point lock assembly 10 is not limited to this particular configuration, however, because the moveable member can be a sliding window, pocket door, other similar types of apparatus.

Figure 2A:
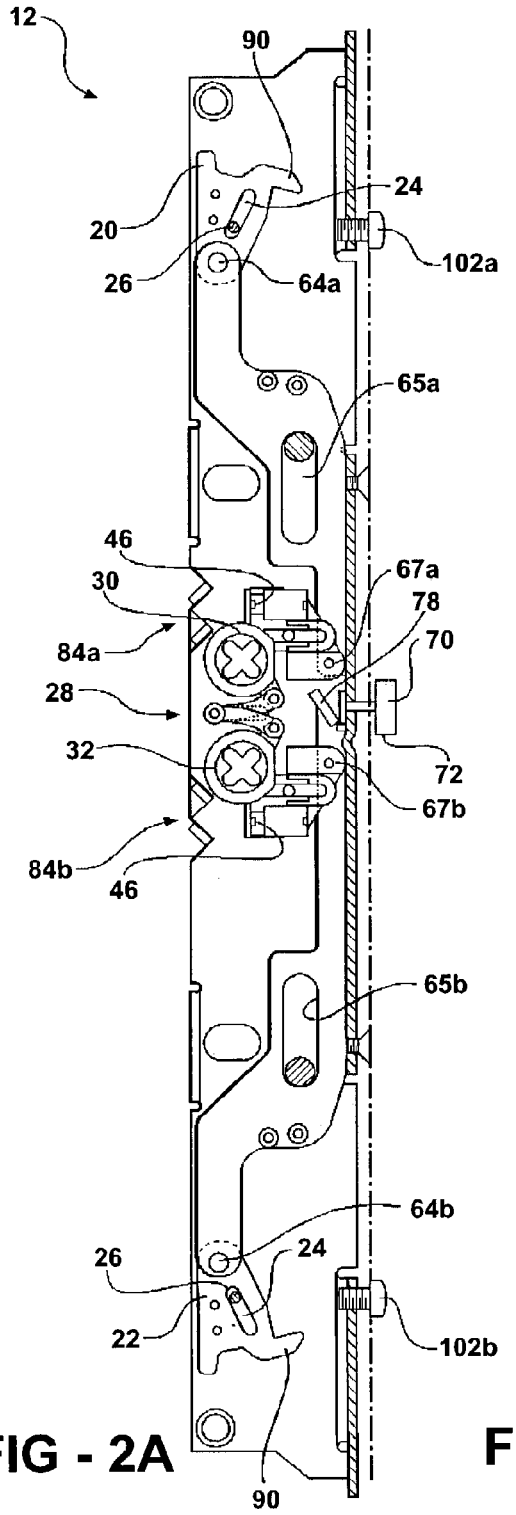
FIG. 2*a* is a side view of a latch unit with latches in an unlocked position.
Figure 2B:
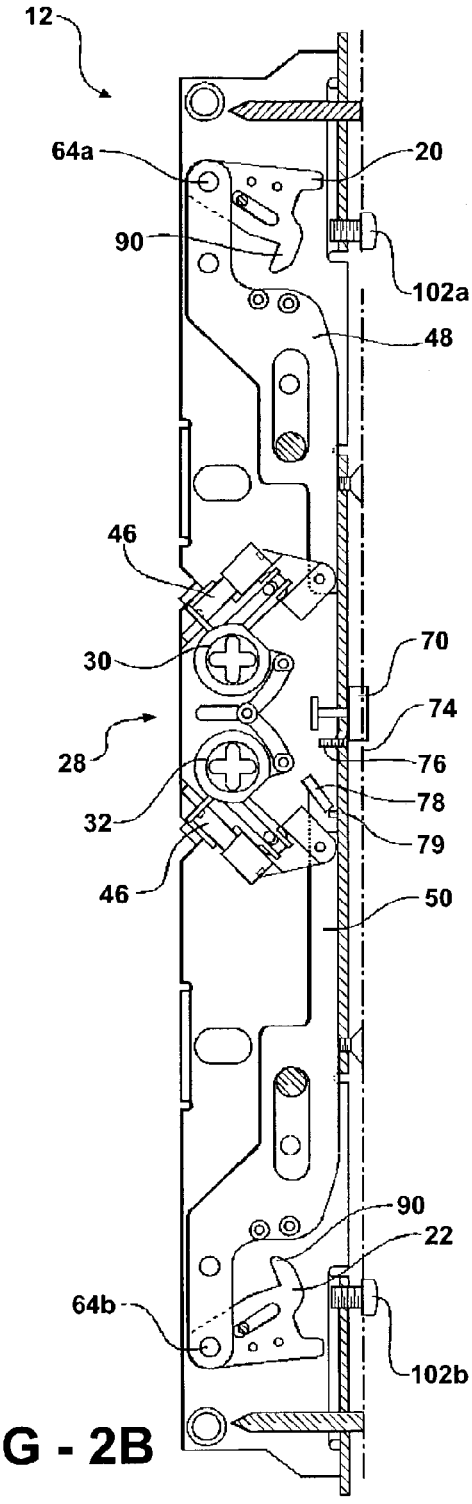
FIG. 2*b* is side view of the latch unit with latches in a locked position.
Figure 2C:
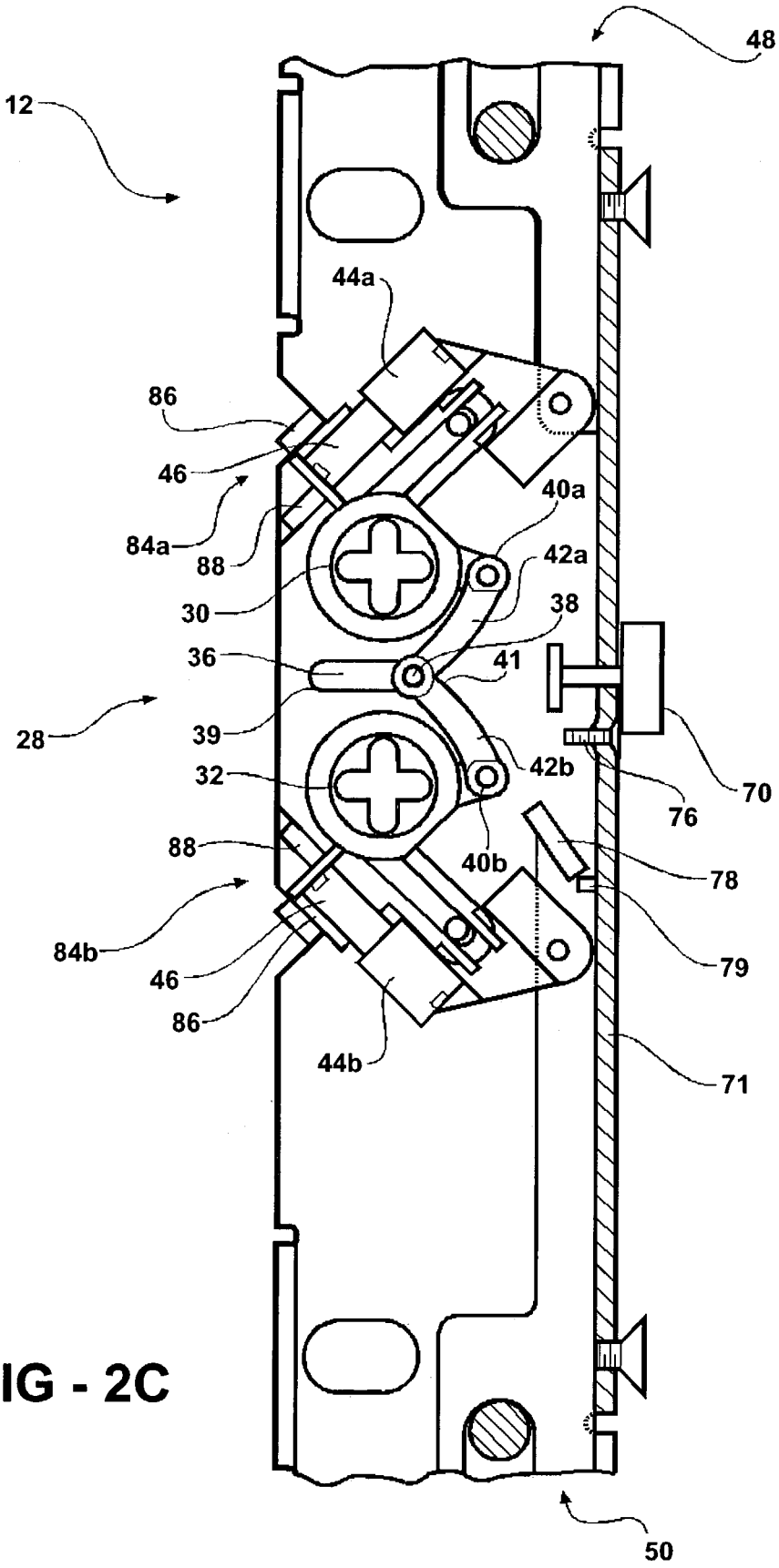
FIG. 2*c* is an enlarged view of the actuator unit shown in FIGS. 2*b* and 2*c*.

Referring now to FIGS. 2*a*, 2*b*, and 2*c*, a side view of the latch unit 12 is shown therein. The latch unit 12 has pair of latches 20, 22. Each latch 20, 22 has a slot 24 that simultaneously slides and pivotally engages with a stationary pin 26. An actuator unit 28 for locking the multi-point lock assembly 10 is actuated by a key or a thumb-turn (not shown). The actuator unit 28 (best seen in FIGS. 2*c* and 3*a*) includes two gears 30 and 32 that are rotationally coupled to one another such that when either gear 30 or 32 is rotationally actuated, the opposing gear 30 or 32 will also rotate at the same angular velocity, but in the opposite direction. The coupling mechanism includes a slot 36 positioned between the two gears 30, 32 such that a sliding pin member 38 can slide from one end 39 of the slot 36 to the other 41 when the gears 30, 32 are rotatingly actuated. Each gear 30, 32 has a pivotal mount 40*a*, 40*b* attached to a connecting member 42*a*, 42*b*, respectively. The connecting members 42*a*, 42*b* are pivotally attached to the pivotal mounts 40*a*, 40*b* on the gears 30, 32 at a first end and pivotally attached to the sliding pin member 38 on the opposite end. For example if gear 30 is rotatingly actuated, the pivotal mount 40*a* rotates with the gear 30. The connecting member 42*a* causes the pin member 38 to translate along the slot 36. The opposing gear 32 is attached in the same manner as gear 30 with the same angular magnitude and velocity, but rotates in an opposite direction of gear 30.

The actuator units include actuator caps 44*a*, 44*b* operably connected to each gear 30, 32 such that the actuator caps 44*a*, 44*b* operate independently from one another. A spring 46 is positioned between each actuator cap 44*a*, 44*b* and their associated gears 30, 32. The springs 46 are compressed when the latch unit is in the unlocked position as shown in FIG. 2*a*. The springs 46 are expanded when the latch unit 12 is in a locked position as shown in FIG. 2*b*.

Figure 3:
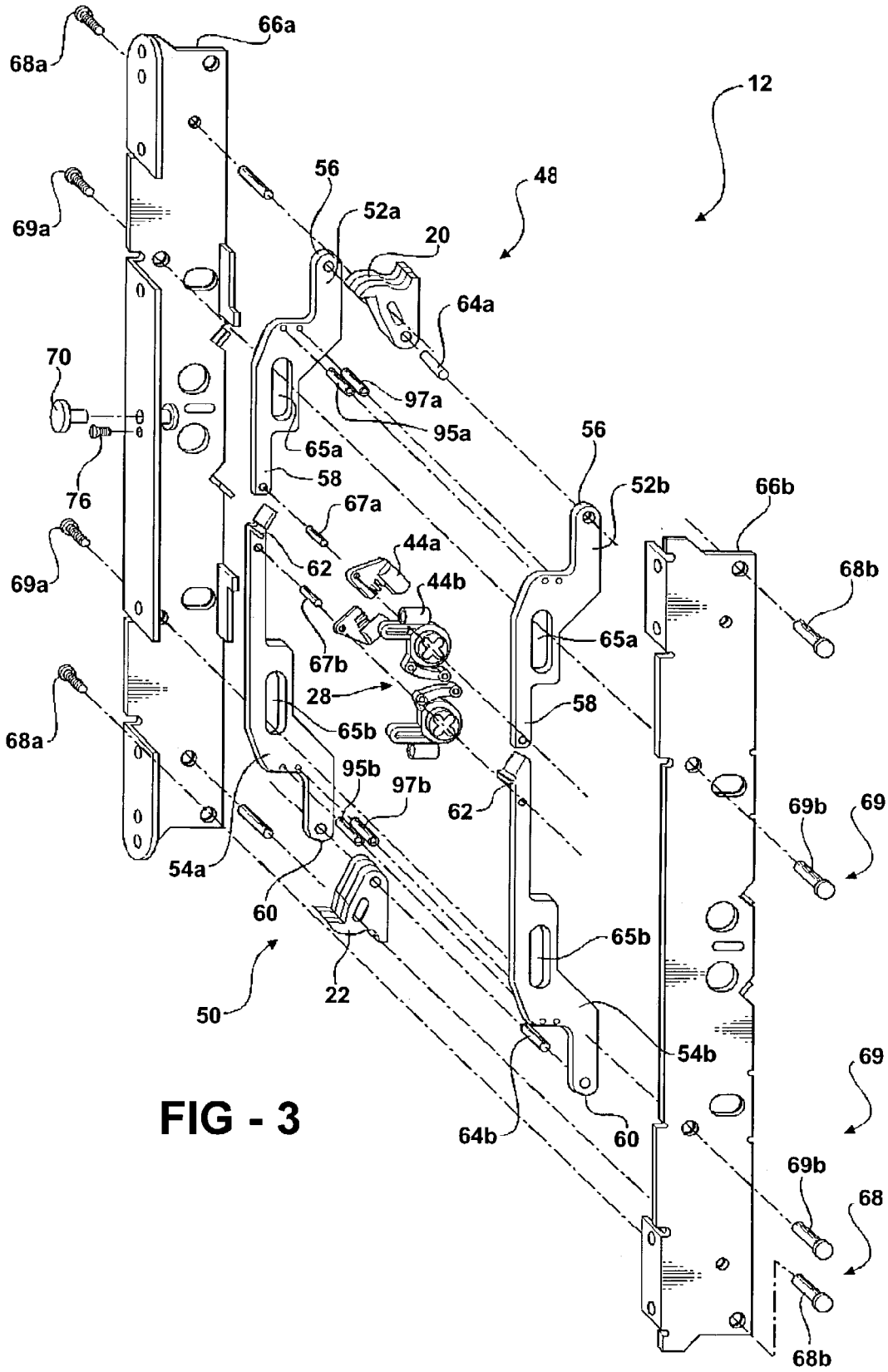
FIG. 3 is an exploded view of the latch unit.

Now referring to FIG. 3, an exploded view of the latch unit 12 is shown therein. The latch unit 12 has a first set of sliding channels bars 48 for actuating the upper latch 20. The first set of sliding channel bars 48 include left 52*a* and right 52*b* channel bar. Each bar 52*a*, 52*b* of the upper set of sliding channel bars 48 includes a first end 56 for pivotally connecting with the upper latch 20. The left and right channel bars 52*a*, 52*b* of the upper channel bar set 48 each have a second end 58 for pivotally connecting with the actuator unit 28. The latch unit 12 includes a second lower set of channel bars 50 having left and right channel bars 54*a* and 54*b*. The left and right channel bars 54*a*, 54*b* of the lower set of channel bars 50 have a first end 60 for pivotally connecting with the lower latch 22. Each channel bar 54*a*, 54*b* of the lower set of channel bars 50 has a second end 62 for pivotally connecting with the actuator unit 28. The upper latch 20 is pivotally connected to a pin 64*a* extending between the first ends 56 of the left and right channel bars 52*a*, 52*b* of the upper set of channel bars 48. Similarly, the lower latch 22 is pivotally connected to a pin 64*b* extending between the first ends 60 of the left and right channel bars 54*a*, 54*b* of the lower set of channel bars 50. The upper actuator cap 44*a* is operably connected to the second ends 58 of the upper channel bar set 48 via pivot pin 67*a*. The lower actuator cap 44*b* of the actuator unit 28 is operably connected to the second end 62 of the lower set of sliding channel bars 50 via pivot pin 67*b*. A pair of side members 66*a*, 66*b* extend longitudinally along the length of the latch unit 12 for providing support for both sets of sliding channel bars 48, 50 and the actuator unit 28. The upper and lower set of sliding channel bars 48, 50 are positioned between the side members 66*a*, 66*b* for holding the latch unit assembly together with a plurality of fasteners 68 extending between the side members 66*a* and 66*b*. Each fastener 68 has an internally threaded rod 68*b* extending through one of the side members 66*b* and a threaded member 68*a* extending from side member 66*a* for threadingly engaging a corresponding threaded rod 68*b*. A second set of stationary pins 69 include a threaded fastener 69*a* extending from side member 66*a* for engaging a corresponding internally threaded rod 69*b* extending through side member 66*b*. A stationary pin 69 engages an elongated groove 65*a*, 65*b* located in the left 52*a*, 54*a* and right 52*b*, 54*b* channel bars of both the upper and lower sets 48, 50 of sliding channel bars, respectively. The elongated grooves 65*a*, 65*b* slidingly engage with the stationary pins 69 as the upper and lower sets 48, 50 of sliding channel bars are reciprocated back and forth during the locking and unlocking sequence of the latch unit 12.

Referring again to FIGS. 2*a*, 2*b*, and 2*c* the latch unit 12 has a release button 70 that is slidingly moveable between a first position 72 (shown in FIG. 2*a*) and a second position 74 (shown in FIG. 2*b*). In the first position 72, the release button is extended outward towards the keeper unit 16. The release button 70 is normally biased via actuator caps 44*a*, 44*b* in the first position 72 when the moveable member 14 is apart from the stationary member 18. The release button 70 is forced towards the latch unit 12 when the moveable member 14 is closed. A detailed description of this procedure is hereinafter provided.

The latch unit 12 has a threaded member 76 extending from a forward edge 71 of the latch unit 12 towards the actuator unit 28. A ramp 78 having a nodule 79 with a substantially horizontal surface at the lower end thereof is connected proximate the second ends 62 of the lower set of channel bars 50. The ramp 78 is angled from the nodule 79 back towards the actuator unit 28. The nodule 79 rests adjacent the threaded member 76 and is prevented from moving past the threaded member 76 when the release button 70 is in the first position 72 as shown in FIG. 2*a*. The threaded member 76 prevents the sliding channel bars 48, 50 from moving when the nodule 79 is in contact with the threaded member 76.

Figures 3A, 3B:
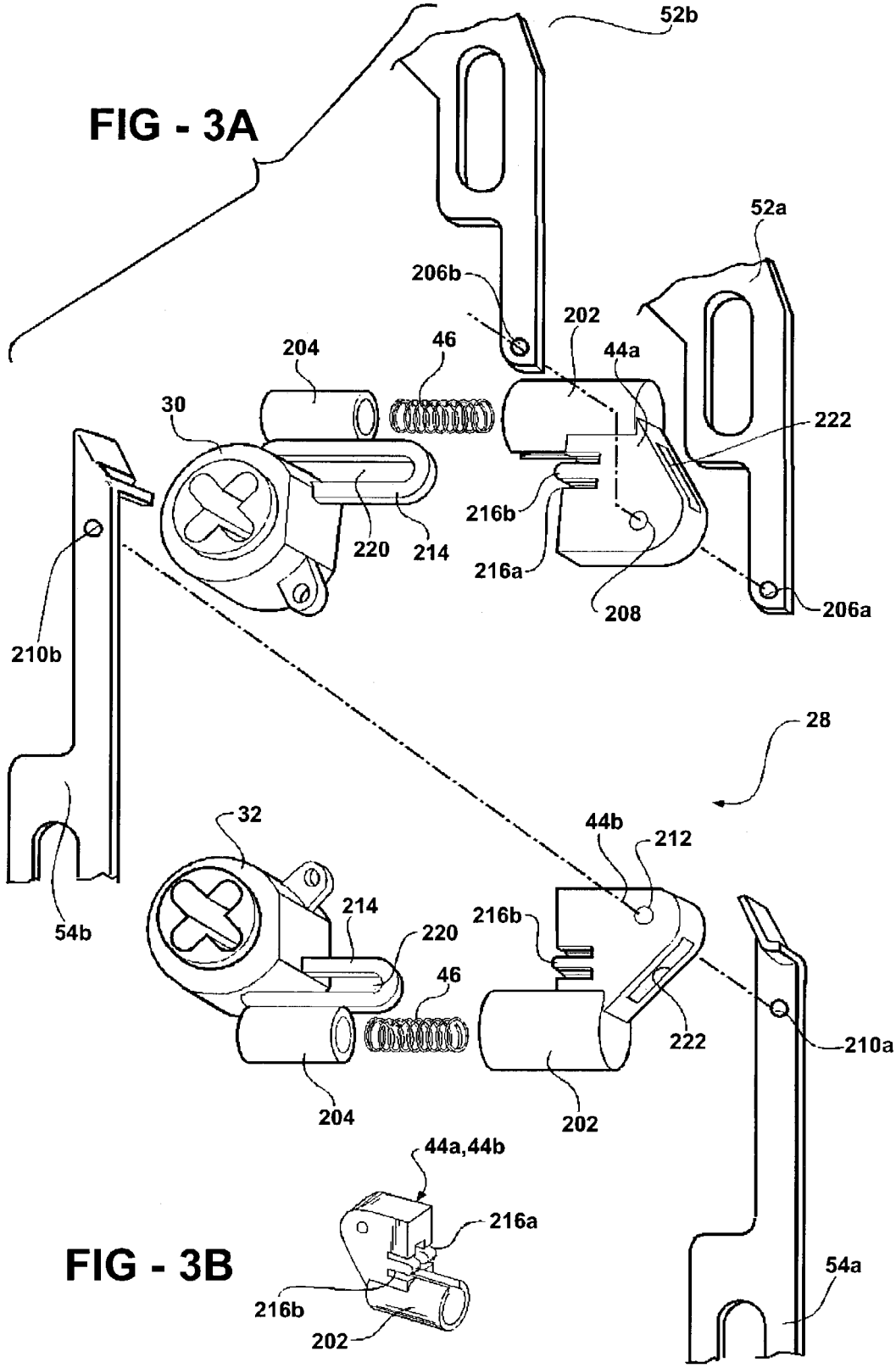
FIG. 3*a* is an enlarged exploded view of the actuator unit of FIG. 3.
FIG. 3*b* is a perspective view of an actuator cap.

Referring to FIGS. 3*a* and 3*b*, an enlarged view of the actuator unit 28 is shown in exploded detail. The actuator caps 44*a*, 44*b* include a spring housing 202 for engaging one end of the spring 46 internally therein. The gears 30, 32 include a lower spring housing 204 for engaging the opposite end of the spring 46. The actuator caps 44*a* and 44*b* are connected with a pin (not shown) extending through apertures 206*a* of channel bar 52*a*, through aperture 208 in the actuator cap 44*a*, and through the aperture 206*b* of the channel bar 52*b*. Similarly, the lower actuator cap 44*b* is operably connected through the lower set of channel bars 54*a* and 54*b* with a pin (not shown). The pin extends through aperture 210*a* of the channel bar 54*a* through an aperture 212 in the lower actuator cap 44*b* and through an aperture 210*b* of channel bar 54*b*. A substantially U-shaped guide 214 integrally extends from each gear 30, 32. Each actuator cap 44*a*, 44*b* include a pair of ears 216*a*, 216*b* that slidingly engage with a substantially U-shaped slot 220 in the U-shaped guide 214. The ears 216*a*, 216*b* of each actuator cap 44*a*, 44*b* are snapped into the corresponding U-shaped slots 220 of the U-shaped guides 214 such that the actuator caps 44*a*, 44*b* will not disengage from the U-shaped slots 220 without forcibly spreading the ears 216*a*, 216*b* apart from one another. The U-shaped guide 214 slides through a slot 222 formed in the actuator caps 44*a*, 44*b*. When the latch unit 12 is in the unlocked position, the actuator caps 44*a*, 44*b* are spaced relatively close to the gears 30, 32 and the springs 46 are in a compressed state. The U-shaped guides 214 extend completely through the slot 222 and out the top of the actuator caps 44*a*, 44*b* in the unlocked position. When the latch unit 12 is in the locked position, the actuator caps 44*a*, 44*b* are spaced farther apart from the gears 30, 32, and the springs 46 expand to maximize the travel of the channel bars 48, 50.

Figure 4A:
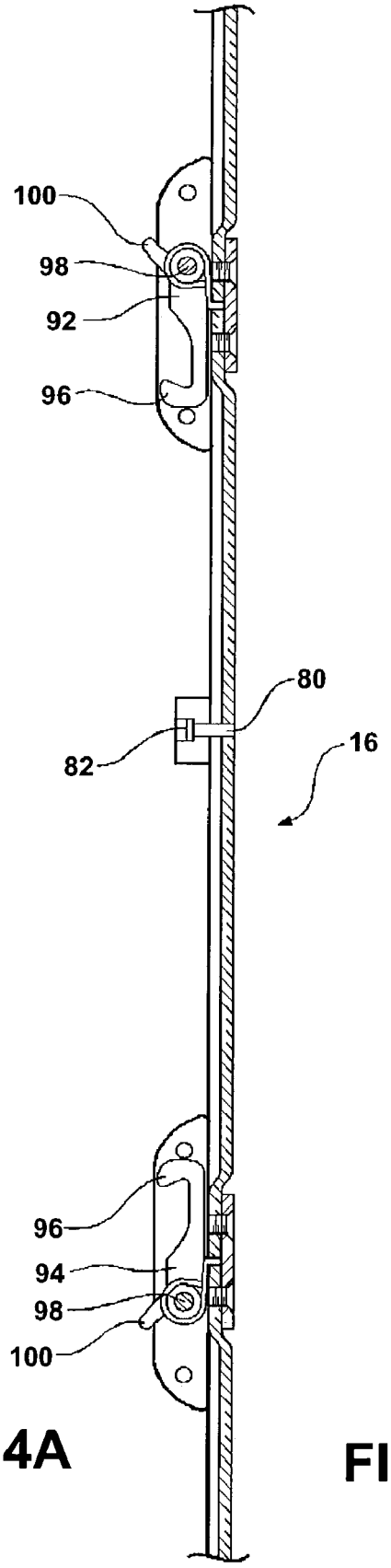
FIG. 4*a* is a side view of the keeper unit with the hooks in an unlocked position.
Figure 4B:
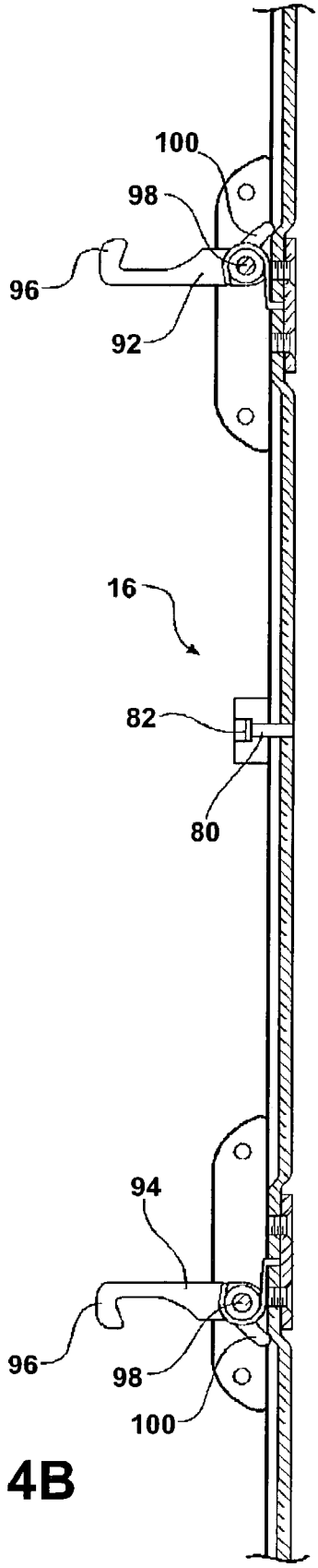
FIG. 4*b* is a side view of the keeper unit with the hooks in a locked position.

Referring now to FIGS. 4*a* and 4*b*, a stop rod 80 is located in the keeper unit 16. The latching unit 12 is restricted from movement until the stop rod 80 contacts the release button 70 when the moveable member is closed. When the moveable member 14 is closed, the stop rod 80, shown in FIGS. 4*a* and 4*b*, contacts the release button 70 and forces the release button 70 into the second position 74 adjacent the front edge 71 of the latch unit 12 (best seen in FIG. 2*b*). The release button 70 forces the ramp 78 towards the actuator unit 28 far enough to slip past the threaded member 76. The ramp 78 and associated nodule 79 can be moved towards the actuator unit 28 because the upper and lower sets of sliding channel bars 48, 50 are operably connected to the actuator caps 44*a*, 44*b* which provide the required play in the assembly. Once the ramp 78 is pushed inward towards the actuator unit 28, the nodule 79 can slide past the threaded member 76, thus permitting the locking unit 12 to continue the locking sequence. The locking unit 12 is restricted from movement until the stop rod 80 contacts the release button 70 when the moveable member is in the closed position. The stop rod 80 includes a tip 82 made of resilient material for easing the impact load of the moveable member 14 when the latch unit 12 of the moveable member 14 contacts the stationary keeper unit 16.

During the unlocking sequence the upper and lower sets of sliding channel bars 48, 50 are actuated such that each set 48, 50 reciprocatingly move in the opposite direction relative to the locking sequence. The ramp 78 is angled to permit the ramp 78 to slide past the threaded member 76 until the nodule 79 is reset adjacent the threaded member 76. The hooks 92, 94 and latches 20, 22 are disengaged prior to the nodule 79 being reset after which the moveable member 14 can then be displaced from the stationary member 18. The release button is biased in the second position 74 due to the actuator caps 44*a*, 44*b* acting though the channel bar set 50 causing the ramp to forcibly move the release button 70. The latch unit 12 can not be actuated again until the moveable member 14 is closed.

Referring back to FIGS. 2*a*, 2*b*, and 2*c*, a pair of actuator cradles 84*a*, 84*b* are included for supporting each actuator cap 44*a*, 44*b* as the actuator caps 44*a*, 44*b* rotate into position during the locking sequence. The actuator cradles 84*a*, 84*b* include two orthogonally positioned ribs 86, 88 for contacting an end and a side of each actuator cap 44*a*, 44*b*. The distal ends of the actuator caps 44*a*, 44*b* extend away from the actuator cradles 84*a*, 84*b* as the actuator caps 44*a*, 44*b* force the channel bar sets 48, 50 outward during the locking sequence.

The latches 20, 22 include substantially L-shaped extensions 90 for engaging corresponding hooks 92 and 94 that are rotated into the latch unit 12 from the keeper unit 16. The hooks 92, 94 have a substantially J-shaped portion 96, as shown in FIGS. 4*a*, and 4*b*. The J-shaped portion 96 extends from a pivot center 98 of rotation. The J-shaped portion 96 engages the L-shaped extensions 90 of the corresponding latches 20, 22 when the latch unit 12 and the keeper unit 16 are locked to one another. A tab 100 on each hook 92, 94 extends from the center rotation 98 at an oblique angle relative to each hook portion 96. Adjustable screws 102*a*, 102*b* shown in FIGS. 2*a* and 2*b* are located on the latch unit 12 for engaging the tabs 100 of each hook 92, 94 and rotating the hooks 92, 94 at a discrete angle into the latch unit 12 when the moveable member 14 closes relative to the stationary member 18. Each hook 92, 94 includes biasing means 104 (best seen in FIGS. 7 and 8) for rotating each hook 92, 94 away from each corresponding latch 20, 22 when the latch unit 12 is unlocked. The biasing means 104 can be a torsional spring wrapped around the pivotal center 98 of each hook 92, 94. The torsional spring is connected to the hooks 92, 94 and to the keeper unit 16.

Referring now to FIG. 5, a side view of the latch unit 12 and the keeper unit 16 is shown in a locked position. The latches 20, 22 are engaged with the hooks 92, 94 along engaging surfaces 23. The upper and lower sets 48, 50 of the sliding channel bars have offset extensions 105*a*, 105*b* integral with inline end portions 93*a*, 93*b*, respectively. The inline end portions 93*a*, 93*b* of the upper and lower channel bars 48, 50 include two pins 95*a*, 97*a* extending between the left and right upper channel bars 52*a*, 52*b*. A pair of lower pins 95*b*, 97*b* extend between the lower set of sliding channel bars 50 between the left and right lower channel bars 54*a*, 54*b*. The upper set of pins 95*a*, 97*a* contact the back side of the hook 92 and continues to rotate the hook 92 until the hook 92 is engaged with the latch 20. At the same time the hook 92 is rotating into locking position, the corresponding latch 20 being pivotally connected to the offset extension 105*a*, through pivot pin 64*a* is also being rotated into locking position with the upper channel bar set 48. Simultaneously, the lower set of pins 95*b*, 97*b* contact the back side of the hook 94 and continues to rotate the hook 94 until the hook 94 is engaged with the latch 22. At the same time the hook 94 is rotating into locking position, the corresponding latch 22 being pivotally connected to the offset extension 105*b*, through pivot pin 64*b* is also being rotated into locking position with the lower channel bar set 50.

Referring now to FIG. 6, a trim plate 106 is connectible to the latch unit 12 for covering the forward front edge 71 thereof. The trim plate 106 includes tapped apertures 108*a*, 108*b* that are threadingly engagable with pointed head marking screws 110 (shown in FIG. 5). The trim plate 106 is fixedly held to the latch unit 12 by a plurality of fasteners (not shown) in addition to the pair of marking screws 110. The trim plate 106 includes through bores 112*a*, 112*b* for each hook 92, 94 to extend through as the hooks 92, 94 rotate into the latch unit 12 from the keeper unit 16. Each bore 112*a*, 112*b* has a bevel 114 formed on a perimeter edge 116 of the side facing the latch unit 12. The beveled edge 114 is operable for preventing the hooks 92, 94 from catching on the back side perimeter edge 116 and jamming therein when the latch assembly 10 moves through the unlocking sequence. The trim plate 106 shown in FIG. 6 is only one example of the various trim plate designs contemplated by the present invention. The trim plate 106 can include flat or pocket designs to coordinate with a variety of back sets.

Figure 7:
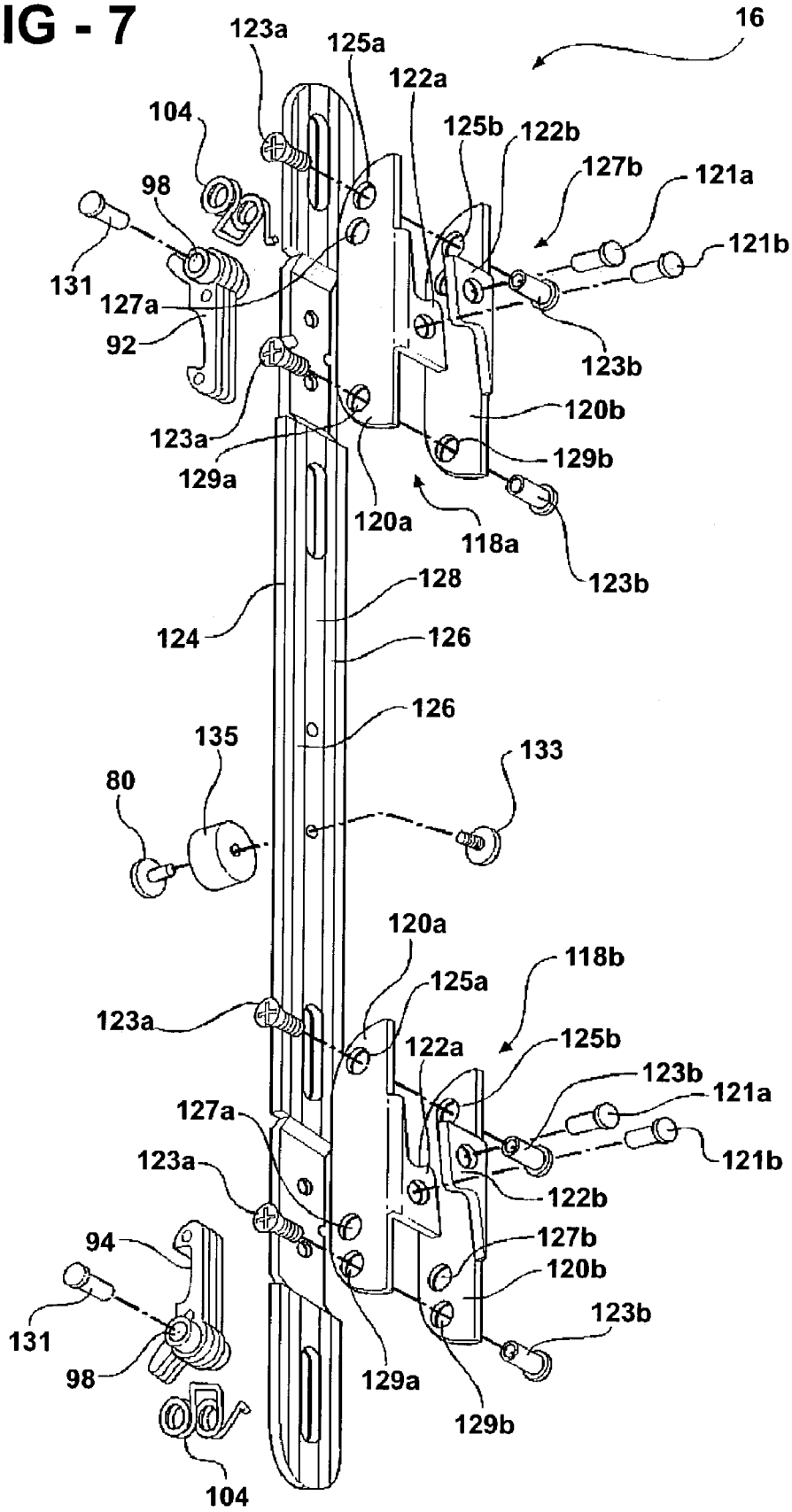
FIG. 7 is an exploded view of a keeper unit in a first embodiment.

Referring now to FIG. 7, a first embodiment of the keeper unit 16 is shown therein. Adjustable clips 118*a*, 118*b* are operably associated with each hook 92, 94 for positioning the hooks 92, 94 at a predetermined location such that the hooks 92, 94 will engage the latch unit 12 at the correct spacial position relative to the keeper unit 16 when the moveable member 14 is in the closed position. Each adjustable clip 118*a*, 118*b* has two sides 120*a*, 120*b* with a mounting member 122*a*, 122*b* extending therebetween for connecting the adjustable clips 118*a*, 118*b* to a keeper plate 124 via fasteners 121*a*, 121*b*. The keeper plate 124 has a plurality of longitudinally extended ribs 126 for increasing the strength of the keeper plate 124 and for forming a counter-bore area 128 for the heads of the threaded fasteners (not shown) to lie therein for connecting the keeper plate to the stationary member 18.

Each adjustable clip 118*a*, 118*b* includes an upper pair of apertures 125*a*, 125*b* and a lower pair of apertures 129*a*, 129*b* extending through the sides 120*a* and 120*b* respectively. Threaded fasteners 123*a* extend through apertures 125*a* and 129*a* located in the side 120*a* for threadably engaging with internally threaded posts 123*b* entering through apertures 125*b* and 129*b* located in the side 120*b* of the adjustable clips 118*a*, 118*b*. The threaded fasteners 123*a* and posts 123*b* prevent sides 120*a*, 120*b* of the adjustable clips from inadvertently spreading too far apart from one another. The hooks 92, 94 are connected through a pivot center 98 with a pivot pin 131 extending through an apertures 127*a* and 127*b* formed in the sides 120*a*, 120*b* respectively of each clip 118*a*, 118*b*. Torsional springs 104 are operably associated with the hooks 92, 94 to ensure each hook rotates out of the latch unit 12 when the closure member 14 is opened.

The stop rod 80 is fixedly held in place with a threaded fastener 133 extending through the keeper plate 124 and a cushioned bumper 135 prior to threadably engaging the stop rod 80. The cushioned bumper 135 ensures that the release button 70 of the latch unit 12 is not damaged if the closure member 14 is slammed shut.

Figure 8:
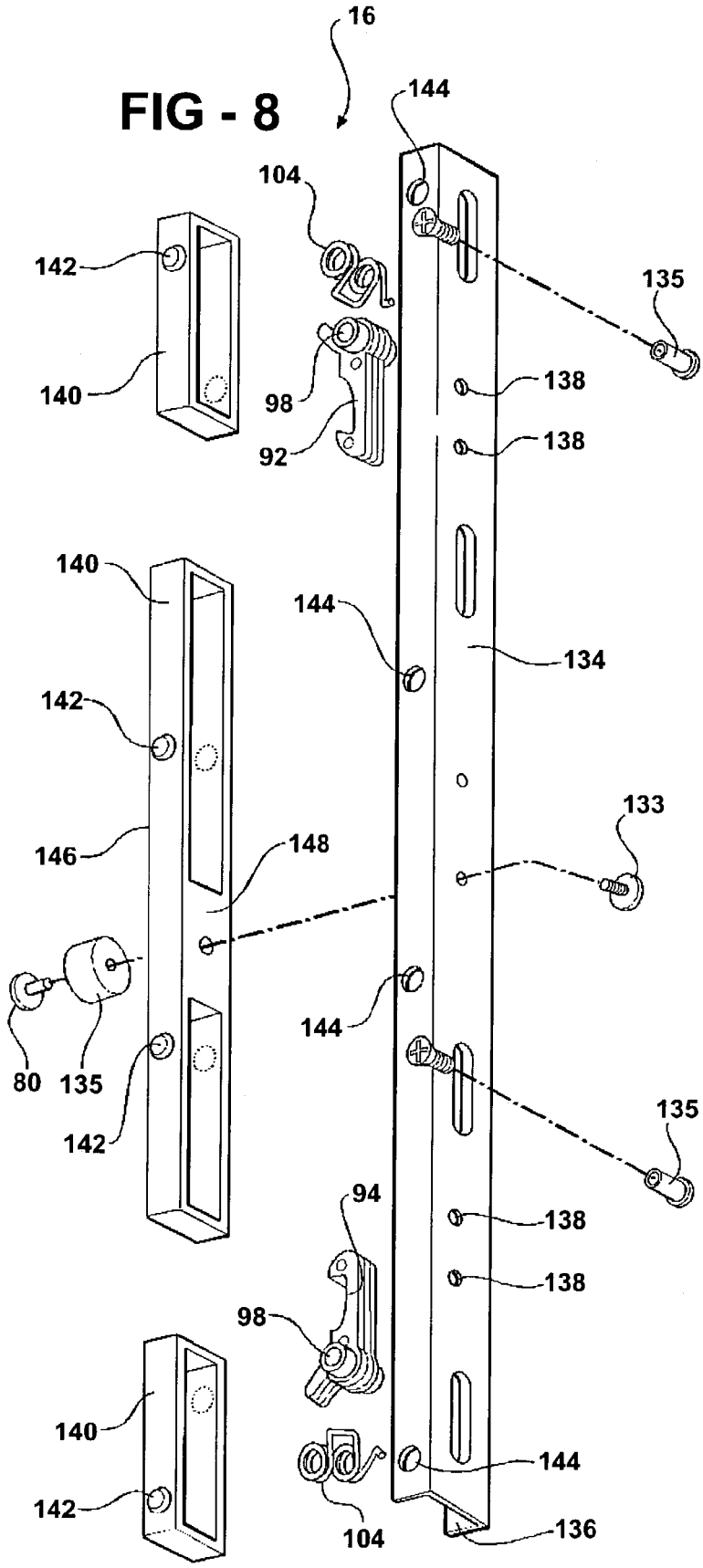
FIG. 8 is an exploded view of a keeper unit in a second embodiment.

Referring now to FIG. 8, a second embodiment of the keeper unit 16 is shown therein. A substantially U-shaped channel keeper 134 having a pivot pin 135 for attaching each hook 92, 94 within the U-shaped recess 136. The channel keeper 134 operable for positioning the hooks 92, 94 at a predetermined location relative to the latch unit 12. The channel keeper 134 has a plurality of apertures 138 for fastening members (not shown) to engage therethrough and fasten the channel keeper 134 to the stationary member 18. A plurality of substantially U-shaped filler members 140 are positioned in the U-shaped channel keeper 134 for covering the U-shaped recess 136 adjacent to the hooks 92, 94. At least one protruding element 142 extends from each side of each U-shaped filler member 140 for releasibly snap-locking with apertures 144 formed in the U-shaped channel keeper 134. The U-shaped channel keeper 134 is typically made of a metal material and the filler members 140 are typically made of a plastic, however, suitable substitute materials for each are contemplated by the present invention. The filler members 140 include a longer member 146 positioned between the hooks 92, 94. The longer filler member 146 has a thicker portion 148 to coincide with the positioning of the stop rod 80. A threaded fastener 133 engages through an aperture located in the thicker portion 148 of the filler member 146 and a cushioned bumper 135 before threadably connecting the stop rod 80 to the U-shaped channel member 134.

Figure 9:
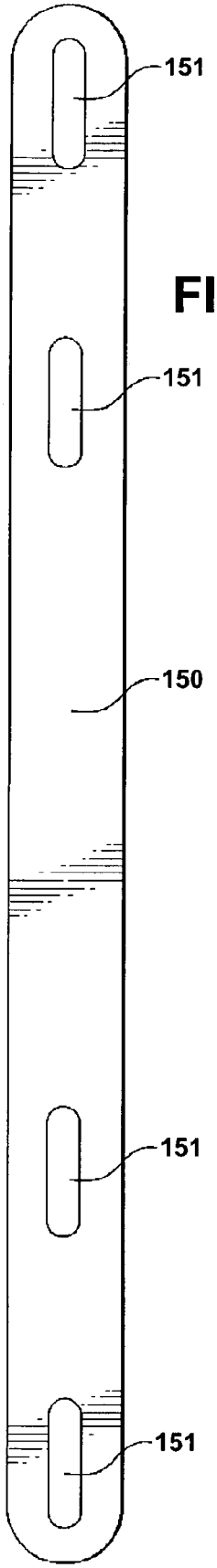
FIG. 9 is a perspective view of a shim.

Referring now to FIG. 9, a shim 150 can be installed between the keeper unit 16 and a wall jamb of the stationary member 18. The shim 150 is used for correctly positioning the keeper unit 16 such that the hooks 92, 94 are engagable with the latches 20, 22. A plurality of elongated apertures 151 are formed in the shim 150 for allowing threaded fasteners (not shown) from the keeper unit 16 to pass therethrough and attach to the stationary member 18. The shim 150 can be pre-installed on the back side of the keeper unit 16 for ease of installation or installed straight into the jamb as desired.

In operation, the multi-point latch assembly 10, requires the moveable member 14 to be shut relative to the stationary member 18 before the locking sequence can be initiated. When the closure member 14 closes, the adjustable screws 102*a*, 102*b* located on the latch unit 12, engage the tabs 100 of each hook 92, 94. The hooks 92, 94 are rotated out of the keeper-unit 16 and into the latch unit 12 when the moveable member 14 is fully closed.

A latch actuator 28 can be actuated after the moveable member 14 is closed. The actuator unit rotates the latches 20, 22 and the corresponding hooks 92, 94 until each engage with one another. The actuator unit 28 automatically adjusts the tension between the hook 92, 94 and the latches 20, 22 via biasing means 44*a*, 44*b*. The engaged surfaces of the latches 20, 22 and the hooks 92, 94 are angled relative to a vertical axis to prevent sliding disengagement caused by an attempted forced entry. While angles greater than zero degrees have been found effective to remain securely engaged with one another, a twelve degree angle on each surface is most preferred. The combination of the angled surfaces and the biasing means 44*a*, 44*b* advantageously cooperate to prevent forced entry into a locked area.

A method for preventing the impact of extended hooks 92, 94 with the moveable member 14 is contemplated by the present invention. The anti-slam feature prevents the hooks 92, 94 and latches 20, 22 from rotating into a locking position when the latch unit 12 is displaced from an engaged position relative to the keeper-unit 16. The hooks 92, 94 and latches 20, 22 can be moved into a locking position only after the release button 70 located on the latch unit 12 is depressed by the stop rod 80 located on the keeper unit 16 when the moveable member 14 is closed.

Figure 10:
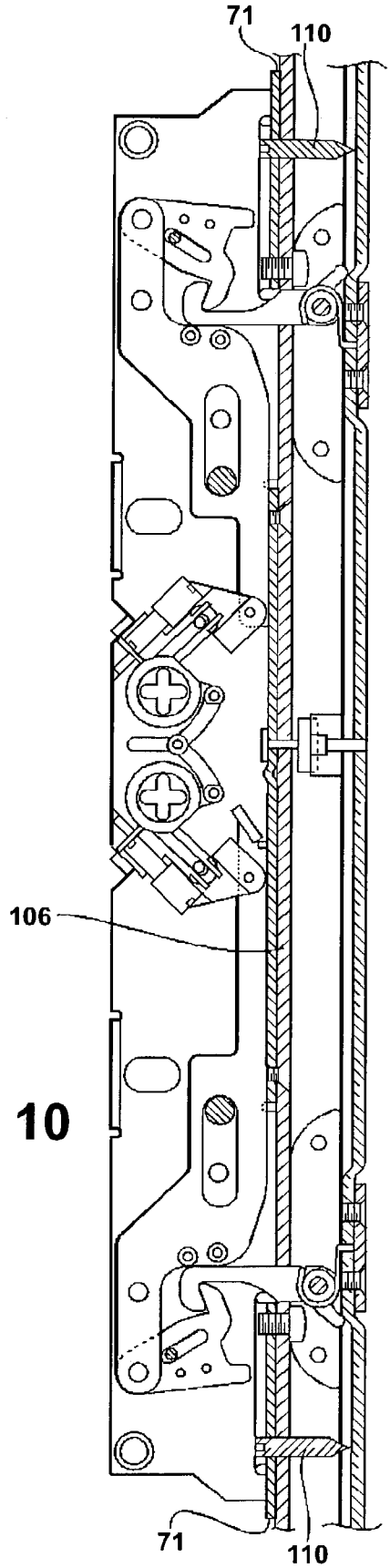
FIG. 10 is a view of the multi-point lock assembly with keeper positioning marking screws.

A method for assembling a multi-point latch assembly 10 is also defined by the present invention. Adjustable rollers on the moveable member 14 are adjusted such that the moveable member 14 is aligned with the stationary member 18. After installing the latch unit 12 into the moveable member 14, at least one screw 110, having a pointed head is threadingly engaged into a trim plate 106 located on the outer edge 71 of the latch unit 12 as shown in FIG. 10. The moveable member 14 is then closed a distance required to mark the stationary member 18 with the at least one pointed head screw 110. The moveable member 14 is then opened and the keeper-unit 16 is aligned with the pre-marked location and installed into the stationary member 18. The pointed head screw 110 is then reversed and threaded into the trim fit plate 106 for fastening the trim plate onto the moveable member.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A method for assembling a multi-point latch assembly comprising the steps of:

adjusting a set of rollers on a closure member for aligning the closure member with a stationary member;

inserting at least one screw having a pointed head into a trim plate located on a forward edge of the moveable member;

marking the stationary member with the pointed head screw by closing the closure member a distance required to contact the stationary member with the pointed head screw;

aligning a keeper unit with the marking on the stationary member;

installing the keeper unit at the marked location; and reversing the screw and fastening a trim plate onto the closure member with the screw.

2. A method of installing a keeper structure for a sliding door latch assembly of the type including a latch for installation on a leading edge of the sliding door and a keeper structure for installation on a jamb against which the sliding door closes, the method comprising:

installing the latch on the leading edge of the sliding door;

installing at least one marker member on a leading edge of the latch projecting forwardly from the leading edge of the latch, wherein the marker member comprises a pointed screw threaded into a trim plate at the leading edge of the latch;

thereafter sliding the door toward the jamb to cause the installed marker member to engage the jamb and form a mark on the jamb, wherein the mark comprises an indentation in the jamb;

thereafter mounting the keeper structure on the jamb in a position relative to the mark such that the latch properly coacts with the keeper structure to latch the door against the jamb; and thereafter removing the marker member from the latch.

3. A method according to claim 2 wherein the latch is a multipoint latch including two hook members and there are two pointed screws installed on the trim plate to respectively locate the two hooks.

4. A method according to claim 2 wherein the keeper structure comprises a plate including openings to receive the hooks and a score mark for alignment with the indentation mark on the jamb.

* * * * *